US011169469B2

(12) United States Patent
Kimura

(10) Patent No.: US 11,169,469 B2
(45) Date of Patent: Nov. 9, 2021

(54) IMAGE FORMING APPARATUS

(71) Applicant: KYOCERA Document Solutions Inc., Osaka (JP)

(72) Inventor: Ryosuke Kimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/090,749

(22) Filed: Nov. 5, 2020

(65) Prior Publication Data

US 2021/0141321 A1 May 13, 2021

(30) Foreign Application Priority Data

Nov. 11, 2019 (JP) ..... JP2019-204130

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS

2012/0237271 A1* 9/2012 Sengoku ..... G03G 15/161 399/296
2013/0051832 A1* 2/2013 Aiba ..... G03G 15/0189 399/71
2014/0064769 A1 3/2014 Sugiura ..... 399/71
2014/0161494 A1 6/2014 Ishizumi et al. ..... 399/301
2015/0362866 A1* 12/2015 Matsushita ..... G03G 21/203 399/44
2019/0049879 A1 2/2019 Ota et al. ..... 15/602

FOREIGN PATENT DOCUMENTS

JP 2011-27849 A 2/2011
JP 2017-44877 A 3/2017

OTHER PUBLICATIONS

Extended European Search Report dated Apr. 13, 2021, issued by the European Patent Office in corresponding application EP 20206675.9.

* cited by examiner

*Primary Examiner* — Clayton E. LaBalle
*Assistant Examiner* — Michael A Harrison
(74) *Attorney, Agent, or Firm* — Stein IP, LLC

(57) ABSTRACT

An image forming apparatus includes a plurality of image forming portions, an intermediate transfer belt, a plurality of primary transfer members, a belt cleaning device, a secondary transfer member, a voltage application device, an image density sensor, and a control section, and executes calibration based on a result of detection by the image density sensor. The control section is capable of executing a cleaning assist mode in which, at the time of executing the calibration, a part of patch images on the intermediate transfer belt is transferred to the secondary transfer member. In a case of forming a toner image on the intermediate transfer belt after one belt revolution, the control section executes the cleaning assist mode, and in a case of not forming the toner image after one belt revolution, the control section continuously applies a reverse transfer voltage to the secondary transfer member.

7 Claims, 8 Drawing Sheets

IMAGE FORMING APPARATUS

INCORPORATION BY REFERENCE

This application is based upon and claims the benefit of priority from the corresponding Japanese Patent Application No. 2019-204130 (filed on Nov. 11, 2019), the contents of which are incorporated herein by reference.

BACKGROUND

The present disclosure relates to an intermediate transfer-type image forming apparatus including an intermediate transfer belt, and particularly to a method for efficiently removing a toner image formed on a surface of the intermediate transfer belt at the time of executing calibration.

There is conventionally known an intermediate transfer-type image forming apparatus including an endless intermediate transfer belt configured to move circularly in a prescribed direction and a plurality of image forming portions provided along the intermediate transfer belt. In the image forming apparatus, by the image forming portions, toner images of respective colors are primarily transferred onto the intermediate transfer belt by being sequentially superimposed on each other, other which the toner images are secondarily transferred onto a recording medium.

In the intermediate transfer-type image forming apparatus configured as above, a belt cleaning device is provided that removes residual toner remaining on the intermediate transfer belt after the secondary transfer. In a case where the intermediate transfer belt has an elastic layer, used is the cleaning device of a type including, in a housing, a cleaning brush that mechanically and electrically collects residual toner remaining on a surface of the intermediate transfer belt, a collection roller that collects the toner from the cleaning brush, a blade that scrapes off the toner from a surface of the collection roller, and a conveyance spiral that conveys the toner scraped off from the surface of the collection roller to a waste toner collection container.

Meanwhile, in such an image forming apparatus, in order to improve color development properties and color reproducibility, it is necessary to perform correction of an image density and a color deviation at prescribed timing. Furthermore, patch images formed at the time of performing correction of an image density or a color deviation are often formed of so-called solid images. Because of this, in a case of removing the patch images by use of the cleaning device, a part of toner transferred onto the intermediate transfer belt may remain without being removed by one round of cleaning with the cleaning brush.

Conventionally, in executing calibration, the number of revolutions (a duration of revolution) of the belt after printing of the patch images is set to be increased so that a sufficient amount of cleaning time of the intermediate transfer belt is secured. This method, however, has been disadvantageous in that a calibration execution time is prolonged, resulting in an increase in printing wait time.

To solve this problem, there is known an image forming apparatus of a type that performs control so that after detection of a density of patch images transferred onto the intermediate transfer belt, a part of the patch images is transferred once to a secondary transfer roller, and then the part of the patch images thus transferred to the secondary transfer roller is transferred again back to the intermediate transfer belt.

Furthermore, it is also known that positions of a plurality of patch images formed by patch image forming portions, respectively, are adjusted so that the patch images as transferred onto the secondary transfer roller are so spaced from each other as to avoid overlapping between them.

SUMMARY

An image forming apparatus according to one aspect of the present disclosure includes a plurality of image forming portions, an intermediate transfer belt, a plurality of primary transfer members, a belt cleaning device, a secondary transfer member, a voltage application device, an image density sensor, and a control section. The image forming apparatus executes calibration in which a density and positional information of patch images formed on the intermediate transfer belt are detected by the image density sensor, and based on a result of the detection, an image forming condition is adjusted so as to correct a density and a color deviation of a toner image. The plurality of image forming portions form images of different colors from each other. The intermediate transfer belt is endless and moves along the image forming portions. The plurality of primary transfer members are each disposed to be opposed, via the intermediate transfer belt, to an image carrier disposed in a corresponding one of the image forming portions and primarily transfer the toner image formed on the image carrier onto the intermediate transfer belt. The belt cleaning device includes a cleaning member disposed at a position opposed to the intermediate transfer belt and removes a residual part of toner remaining on a surface of the intermediate transfer belt. The secondary transfer member secondarily transfers, onto a recording medium, the toner image primarily transferred onto the intermediate transfer belt. The voltage application device applies, to the secondary transfer member, a transfer voltage having a polarity opposite to a polarity of the toner or a reverse transfer voltage having a polarity identical to the polarity of the toner. The image density sensor detects a density and positional information of the toner image primarily transferred onto the intermediate transfer belt. The control section controls the image forming portions and the voltage application device. The control section is capable of executing a cleaning assist mode in which, at the time of executing the calibration, a part of the patch images formed on the intermediate transfer belt is transferred to the secondary transfer member. In a case of forming the toner image on the intermediate transfer belt after the intermediate transfer belt has revolved once, the control section executes the cleaning assist mode, and in a case of not forming the toner image on the intermediate transfer belt after the intermediate transfer belt has revolved once, the control section continuously applies the reverse transfer voltage to the secondary transfer member.

Still other objects of the present disclosure and specific advantages provided by the present disclosure will be made further apparent from the following description of an embodiment.

DETAILED DESCRIPTION

Figure 1:
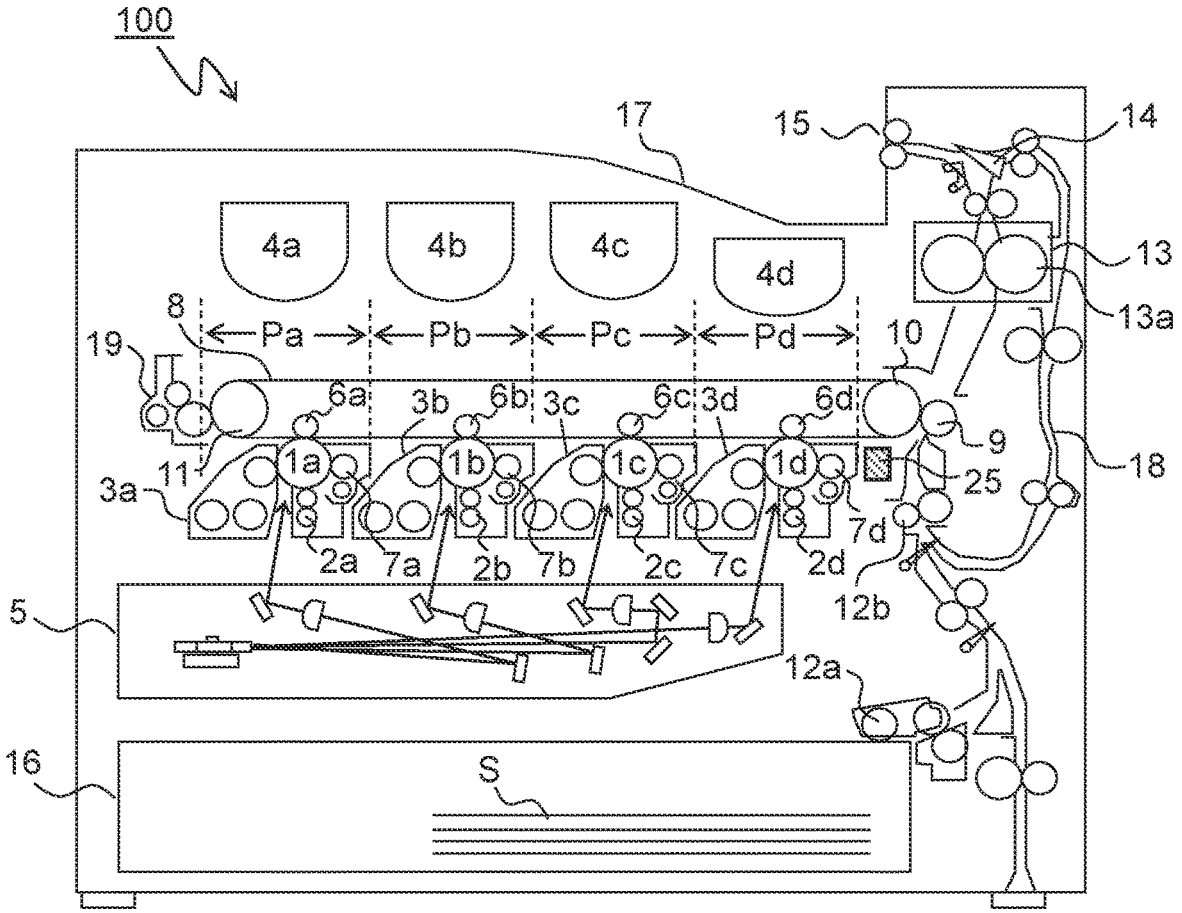
FIG. 1 is a schematic view showing an internal configuration of an image forming apparatus according to one embodiment of the present disclosure.
Figure 2:
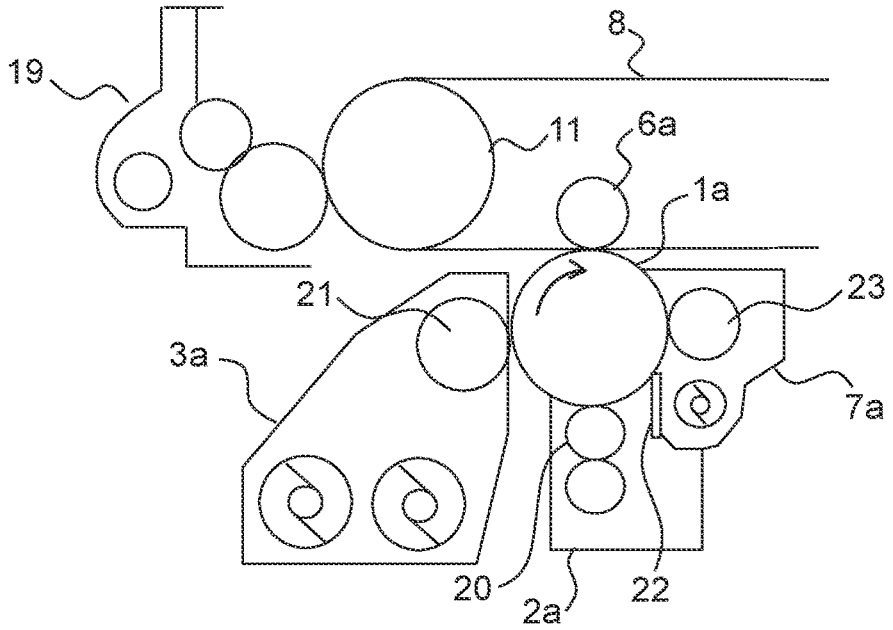
FIG. 2 is an enlarged view of a vicinity of an image forming portion in FIG. 1.

With reference to the appended drawings, the following describes an embodiment of the present disclosure. FIG. 1 is a schematic view showing a configuration of an image forming apparatus 100 according to one embodiment of the present disclosure, and FIG. 2 is an enlarged view of a vicinity of an image forming portion Pa in FIG. 1.

The image forming apparatus 100 shown in FIG. 1 is a so-called tandem-type color printer and is configured as follows. That is, in a main body of the image forming apparatus 100, four image forming portions Pa, Pb, Pc and Pd are provided in order from an upstream side in a conveyance direction (a left side in FIG. 1). The image forming portions Pa to Pd are provided so as to correspond to images of four different colors (magenta, cyan, yellow, and black) and sequentially form images of magenta, cyan, yellow, and black, respectively, by following steps of charging, exposure, development, and transfer.

In the image forming portions Pa to Pd, photosensitive drums 1*a*, 1*b*, 1*c*, and 1*d* are provided, respectively, that carry visible images (toner images) of the respective colors, respectively. Moreover, an intermediate transfer belt 8 that rotates in a counterclockwise direction in FIG. 1 is provided adjacently to the image forming portions Pa to Pd. Toner images formed on the photosensitive drums 1*a* to 1*d*, respectively, are sequentially transferred onto the intermediate transfer belt 8 that moves while being in contact with the photosensitive drums 1*a* to 1*d* and then, on a secondary transfer roller 9, are transferred at once onto a sheet S as one example of a recording medium. Moreover, the toner images are fixed on the sheet S in a fixing portion 13, and then the sheet S is discharged from the main body of the image forming apparatus 100. While the photosensitive drums 1*a* to 1*d* are caused to rotate in a clockwise direction in FIG. 1, an image forming process with respect to each of the photosensitive drums 1*a* to 1*d* is executed.

The sheet S to which toner images are to be transferred is contained in a sheet cassette 16 at a lower portion of the main body of the image forming apparatus 100 and is conveyed to the secondary transfer roller 9 via a paper feed roller 12*a* and a registration roller pair 12*b*. A seam-free (seamless) belt is mainly used as the intermediate transfer belt 8.

Next, a description is given of the image forming portions Pa to Pd. While the following describes the image forming portion Pa in detail, descriptions of the image forming portions Pb to Pd are omitted since they basically have similar configurations to that of the image forming portion Pa. As shown in FIG. 2, around the photosensitive drum 1*a*, a charging device 2*a*, a developing device 3*a*, and a cleaning device 7*a* are provided along a drum rotation direction (a clockwise direction in FIG. 2), and a primary transfer roller 6*a* is disposed opposite the photosensitive drum 1*a* via the intermediate transfer belt 8. Furthermore, on an upstream side in a rotation direction of the intermediate transfer belt 8 with respect to the photosensitive drum 1*a*, a belt cleaning unit 19 is disposed to be opposed to a tension roller 11 via the intermediate transfer belt 8.

Next, a description is given of an image forming procedure in the image forming apparatus 100. Upon an instruction to start image formation being inputted by a user, first, the photosensitive drums 1*a* to 1*d* are started to rotate by a main motor 61 (see FIG. 8), and a surface of each of the photosensitive drums 1*a* to 1*d* is uniformly charged by a charging roller 20 of a corresponding one of the charging devices 2*a* to 2*d*. Subsequently, the surface of each of the photosensitive drums 1*a* to 1*d* is irradiated with beam light (laser light) emitted from an exposure device 5, and thus an electrostatic latent image corresponding to an image signal is formed on each of the photosensitive drums 1*a* to 1*d*.

Each of the developing devices 3*a* to 3*d* is filled with a prescribed amount of toner of a corresponding one of the respective colors of magenta, cyan, yellow, and black. In a case where a percentage of toner in a two-component developer filled in each of the developing devices 3*a* to 3*d* falls below a preset value due to after-mentioned toner image formation, the developing devices 3*a* to 3*d* are replenished with toner from toner containers 4*a* to 4*d*, respectively. The toner in the developer is supplied onto each of the photosensitive drums 1*a* to 1*d* by a developing roller 21 of a corresponding one of the developing devices 3*a* to 3*d* and electrostatically adheres thereto. Thus, there is formed a toner image corresponding to the electrostatic latent image formed by exposure from the exposure device 5.

Further, by each of the primary transfer rollers 6*a* to 6*d*, an electric field is applied at a prescribed transfer voltage between itself and a corresponding one of the photosensitive drums 1*a* to 1*d*, and thus the toner images of magenta, cyan, yellow, and black respectively on the photosensitive drums 1*a* to 1*d* are primarily transferred onto the intermediate transfer belt 8. These images of the four different colors are formed in a prescribed positional relationship predetermined for formation of a prescribed full-color image. After that, residual toner remaining on the surface of each of the photosensitive drums 1*a* to 1*d* is removed by a cleaning blade 22 and a rubbing roller 23 of a corresponding one of the cleaning devices 7*a* to 7*d* in preparation for a subsequent process of forming a new electrostatic latent image.

As a drive roller 10 is driven to rotate by a belt drive motor 63 (see FIG. 8), the intermediate transfer belt 8 starts to rotate in the counterclockwise direction. Further, at prescribed timing, the sheet S is conveyed from the registration roller pair 12*b* to the secondary transfer roller 9 provided adjacently to the intermediate transfer belt 8, where the full-color image is transferred thereon. The sheet S onto which the toner images have been transferred is conveyed to the fixing portion 13. Residual toner remaining on a surface of the intermediate transfer belt 8 is removed by the belt cleaning unit 19.

The sheet S thus conveyed to the fixing portion 13 is heated and pressed by a fixing roller pair 13*a* so that the toner images are fixed on a surface of the sheet S, and thus the prescribed full-color image is formed thereon. A conveyance direction of the sheet S on which the full-color image has been formed is switched by a branch portion 14 branching off in a plurality of directions, and thus the sheet S is directly (or after being conveyed to a double-sided conveyance path 18 and thus being subjected to double-sided printing) discharged to a discharge tray 17 by a discharge roller pair 15.

An image density sensor 25 is disposed at a position opposed to the drive roller 10 via the intermediate transfer belt 8. As the image density sensor 25, an optical sensor is typically used that includes a light-emitting element formed of an LED or the like and a light-receiving element formed of a photodiode or the like. In measuring an amount of toner adhering on the intermediate transfer belt 8, patch images (reference images) formed on the intermediate transfer belt 8 are irradiated with measurement light from the light-emitting element, so that the measurement light enters the light-receiving element as light reflected by the toner and light reflected by the belt surface.

The reflection light from the toner and the reflection light from the belt surface include a regular reflection light component and an irregular reflection light component. The regular reflection light component and the irregular reflection light component are obtained by splitting with a polarization splitting prism and then enter separate light-receiving elements, respectively. Each of the light-receiving elements performs photoelectric conversion of the received one of the regular reflection light component and the irregular reflection light component and outputs an output signal to a control section 90 (see FIG. 8).

Further, from a characteristic change in the output signals based on the regular reflection light component and the irregular reflection light component, respectively, an image density (a toner amount) and an image position of the patch images are detected and compared with a predetermined reference density and a predetermined reference position, respectively, so as to be used to adjust a Characteristic value of a developing voltage, an exposure start position and exposure start timing of the exposure device 5, and so on. In this manner, for each of the respective colors, density correction and color deviation correction (calibration) are performed.

Figure 3:
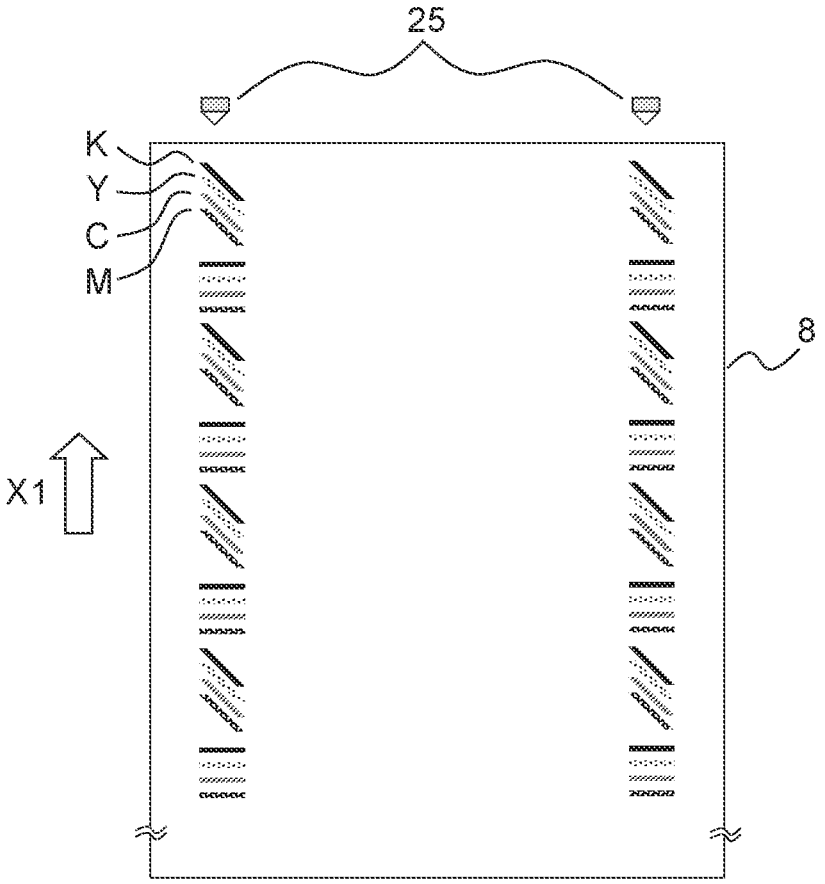
FIG. 3 is a view showing one example of reference images for color deviation correction used in calibration.

FIG. 3 is a view showing one example of patch images (reference images) for color deviation correction used in calibration. Reference images formed of oblique and lateral lines M, C, Y, and K of the respective colors of magenta, cyan, yellow, and black are formed at each of both ends of the intermediate transfer belt 8 in a width direction thereof. An arrow X1 indicates a belt travel direction. FIG. 3 shows a typical pattern of the reference images M, C, Y, and K, in which the oblique and lateral lines of the respective colors are used to detect a color deviation in a main scanning direction (a belt width direction) and a distance between the lateral lines of the respective colors is used to detect a color deviation in a sub-scanning direction (a belt circumferential direction).

Furthermore, the reference images M, C, Y, and K are formed in an identical pattern at each of both the ends in the main scanning direction (the belt width direction), and thus main scanning magnification accuracy and scanning inclination can be detected. Moreover, in order to reduce variations in detecting a color deviation in the belt circumferential direction, the reference images M, C, Y, and K are formed repeatedly in the sub-scanning direction, and a mean value of deviation amounts obtained by measuring the identical pattern plural times is used as a value of the color deviation. A positional relationship between the oblique and straight lines of the respective colors is detected by the image density sensor 25 and compared with a predetermined reference position. In a case of correcting a color deviation in the main scanning direction, an exposure start position of the exposure device 5 is adjusted, and in a case of correcting a color deviation in the sub-scanning direction, exposure start timing of the exposure device 5 is adjusted. In this manner, for each of the respective colors, color deviation correction is performed.

Figure 4:
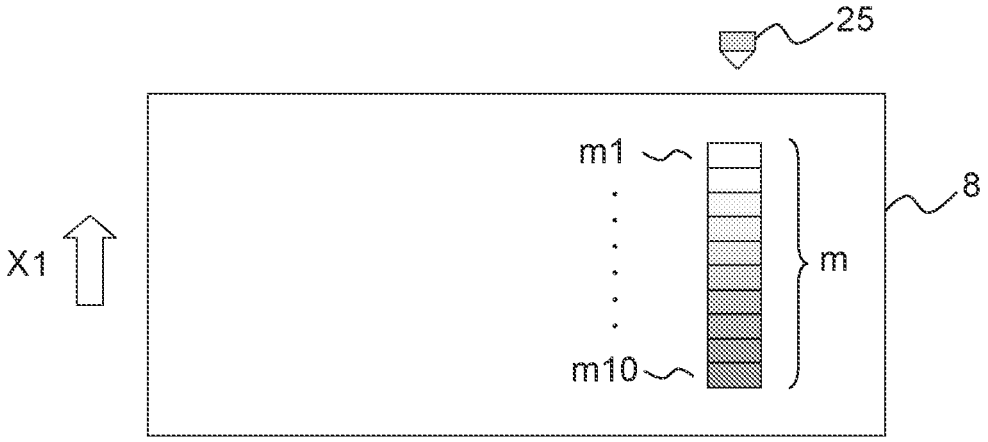
FIG. 4 is a view showing one example of reference images for density correction used in calibration.

FIG. 4 is a view showing one example of patch images (reference images) for density correction used in calibration. At one end of the intermediate transfer belt 8 in the width direction thereof, reference images m formed of patch images m1 to m10 in ten different density levels, ranging from the image m1 of the lightest color to the image m10 of the darkest color, are formed in a row in order from a downstream side along the belt travel direction (an arrow X1 direction). Adjacent ones of the patch images are each so formed in a single color that the color varies in density at boundaries therebetween. While the description herein uses the reference images m of magenta as an example, exactly the same is true with the reference images c of cyan, the reference images y of yellow, and the reference images k of black.

An amount of toner adhering (a toner density) to each of the reference images m, c, y, and k is detected by the image density sensor 25 and compared with a predetermined standard density, and a mean value of density differences between values of the toner density and the standard density is calculated. Based on the thus obtained mean value of the density differences, a parameter value used for density correction is read from a density correction table and used to execute the density correction for each of the respective colors.

Figure 5:
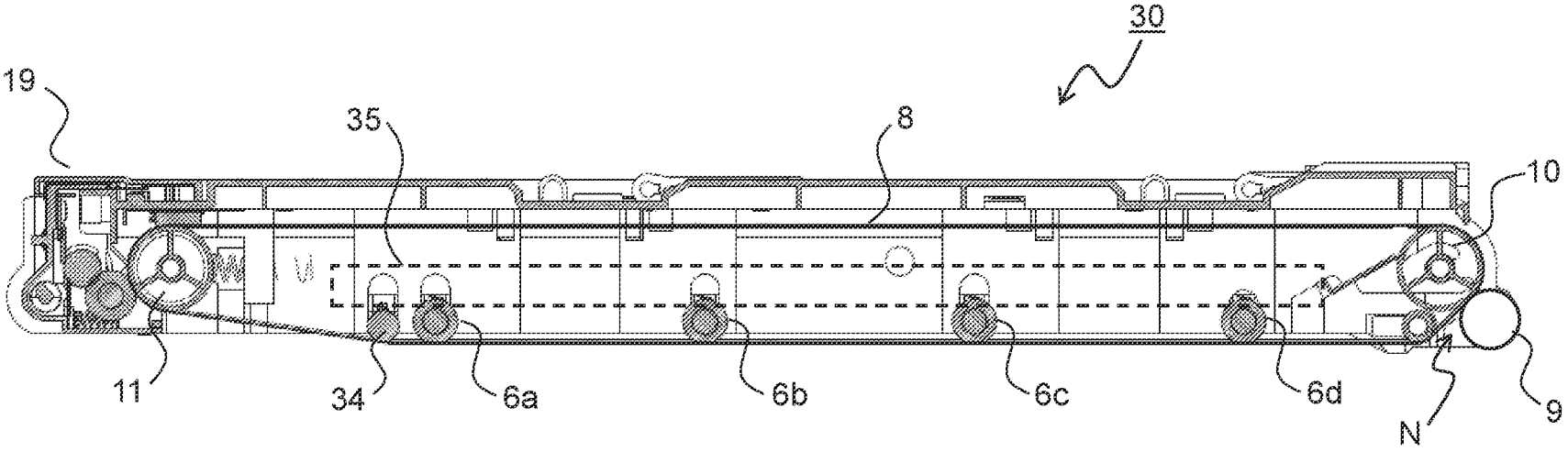
FIG. 5 is a side sectional view of an intermediate transfer unit mounted in the image forming apparatus.

FIG. 5 is a side sectional view of an intermediate transfer unit 30 mounted in the image forming apparatus 100. As shown in FIG. 5, the intermediate transfer unit 30 includes the intermediate transfer belt 8 laid over the drive roller 10 on a downstream side and the tension roller 11 on an upstream side, the primary transfer rollers 6*a* to 6*d* contacting the photosensitive drums 1*a* to 1*d*, respectively, via the intermediate transfer belt 8, and a pressing force switching roller 34. Furthermore, the belt cleaning unit 19 for removing residual toner remaining on the surface of the intermediate transfer belt 8 is disposed at a position opposed to the tension roller 11. A detailed configuration of the belt cleaning unit 19 will be described later.

The intermediate transfer unit 30 includes a roller contact/retract mechanism 35 including a pair of support members (not shown) that support both ends of a rotary shaft of each of the primary transfer rollers 6*a* to 6*d* and the pressing force switching roller 34 so that they are rotatable and movable perpendicularly (in an up-down direction in FIG. 5) with respect to the travel direction of the intermediate transfer belt 8, a driver (not shown) that drives the primary transfer rollers 6*a* to 6*d* and the pressing force switching roller 34 to reciprocate in the up-down direction. The roller contact/retract mechanism 35 is switchable among a color mode in which the four primly transfer rollers 6*a* to 6*d* are brought into pressure contact with the photosensitive drums 1*a* to 1*d*, respectively, via the intermediate transfer belt 8 (see FIG. 1), a monochrome mode in which only the primary transfer roller 6*d* is brought into pressure contact with the photosensitive drum 1*d* via the intermediate transfer belt 8, and a retraction mode in which all the four primary transfer rollers 6*a* to 6*d* are separated from the photosensitive drums 1*a* to 1*d*, respectively.

Specifically, the roller contact/retract mechanism 35 causes the pressing force switching roller 34 to move upward so that the primary transfer rollers 6*a* to 6*d* move upward together with the intermediate transfer belt 8, and thus the primary transfer rollers 6*a* to 6*d* are separated from the photosensitive drums 1*a* to 1*d*, respectively. Here, the pressing force switching roller 34 is disposed closer to the tension roller 11 than the primary transfer roller 6*a* is, and thus a lower surface (a contact surface with the photosensitive drums 1*a* to 1*d*) of the intermediate transfer belt 8 swings up and down about the drive roller 10 as a fulcrum. A distance between the intermediate transfer belt 8 and each of the photosensitive drums 1*a* to 1*d*, therefore, is largest near the photosensitive drum 1*a* and smallest near the photosensitive drum 1*d*. That is, adjusting an amount of movement of the pressing force switching roller 34 enables switching among the color mode, the monochrome mode, and the retraction mode.

Figure 6:
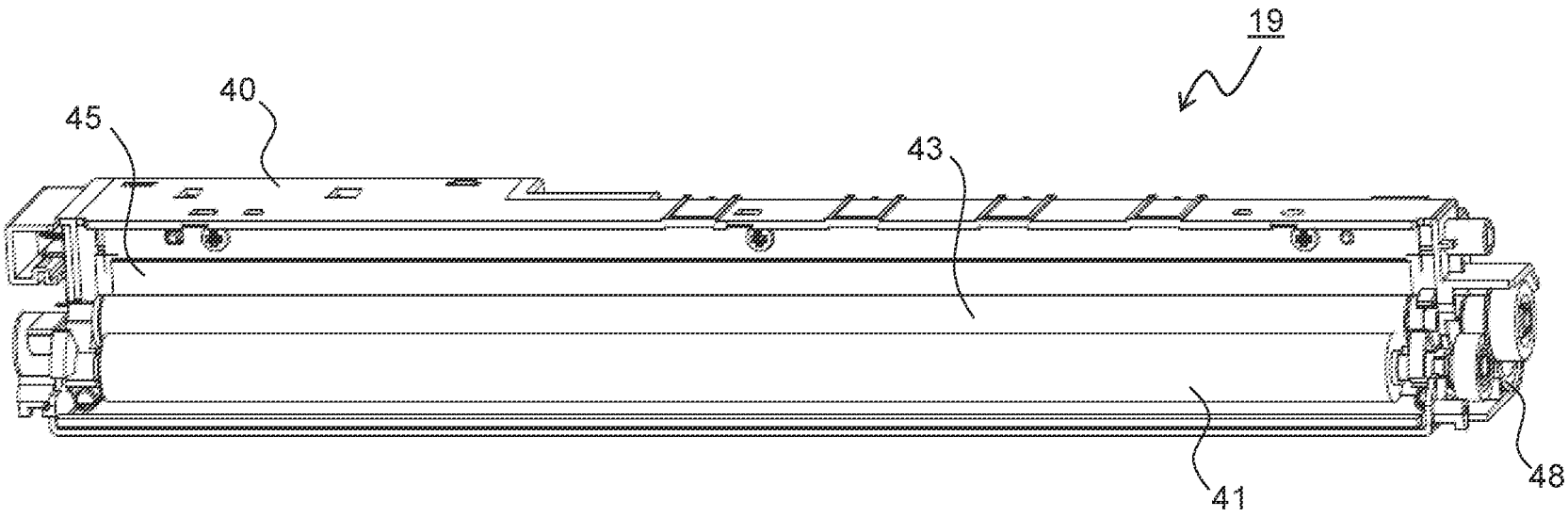
FIG. 6 is an external perspective view of a belt cleaning unit shown in FIG. 5.
Figure 7:
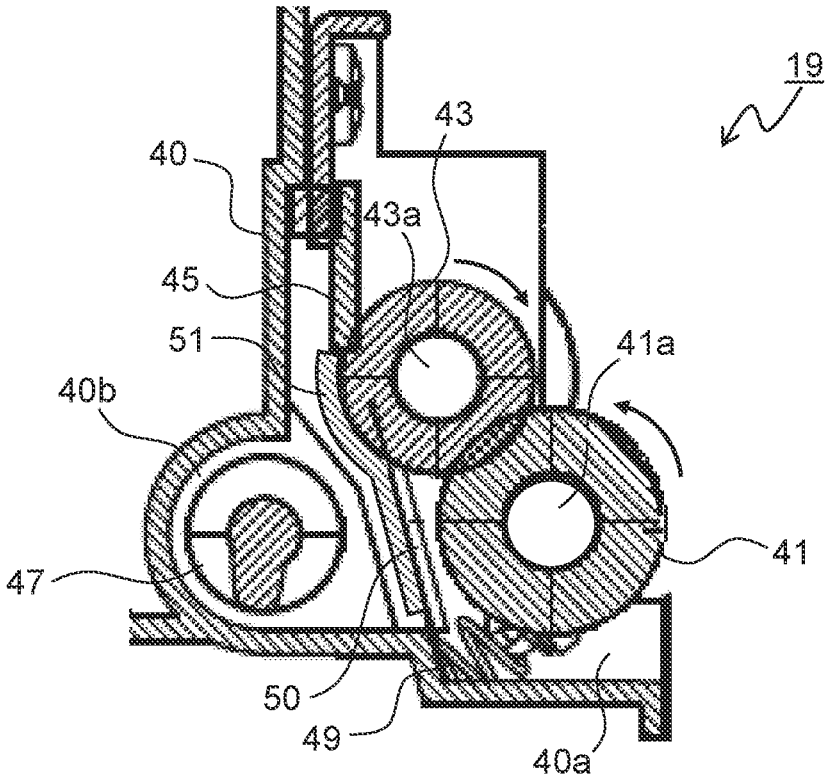
FIG. 7 is a side sectional view showing an internal configuration of the belt cleaning unit.

FIG. 6 is an external perspective view of the belt cleaning unit 19 in the intermediate transfer unit 30 shown in FIG. 5. FIG. 7 is a side sectional view showing an internal configuration of the belt cleaning unit 19. The belt cleaning unit 19 includes, in a housing 40, a fur brush 41, a collection roller 43, a blade 45, and a conveyance spiral 47. A drive input gear train 48 that inputs a drive force from a cleaning drive motor (not shown) to the fur brush 41, the collection roller 43, and the conveyance spiral 47 is disposed at one end of the housing 40.

The fur brush 41 is disposed near an opening 40*a* of the housing 40 so as to be opposed to the tension roller 11 via the intermediate transfer belt 8. The fur brush 41 rotates in a counter direction (a counterclockwise direction in FIG. 7) to a moving direction of the intermediate transfer belt 8, thus scraping off foreign matter such as residual toner or paper dust remaining on the intermediate transfer belt 8 (hereinafter, referred to as residual toner or the like). A brush portion of the fur brush 41, which contacts the collection roller 43, is made of an electrically conductive fiber having a resistance value of about 1 MΩ to 900 MΩ.

The collection roller 43 rotates in an opposite direction to the rotation direction of the fur brush 41 (a clockwise direction in FIG. 7) while being in contact with a surface of the fur brush 41, thus collecting residual toner or the like adhering to the fur brush 41. A belt cleaning voltage power supply 75 (see FIG. 8) is connected to the collection roller 43, and at the time of cleaning the intermediate transfer belt 8, a cleaning voltage having a polarity (here, a negative polarity) opposite to that of toner is applied to the collection roller 43. Furthermore, the tension roller 11 is grounded. As a result, residual toner or the like remaining on the intermediate transfer belt 8 is electrically and mechanically collected by the brush portion of the fur brush 41 and is further caused to electrically move to the collection roller 43.

A rotary shaft 41*a* of the fur brush 41 and a rotary shaft 43*a* of the collection roller 43 are rotatably supported to the housing 40. Furthermore, the rotary shaft 41*a* of the fur brush 41 is biased in an upper right direction in FIG. 7 (a direction toward the tension roller) by a compression spring 49.

The blade 45 contacts the collection roller 43 from a downstream side with respect to the rotation direction of the collection roller 43 (a counter direction to a moving direction of a surface of the collection roller 43) so as to scrape off residual toner or the like collected by the collection roller 43, thus cleaning the collection roller 43. The conveyance spiral 47 is disposed in a toner housing portion 40*b* of the housing 40 and conveys residual toner or the like scraped off from the collection roller 43 by the blade 45 to a waste toner collection container (not shown) outside the housing 40.

In the housing 40, a sheet member 50 is disposed to be opposed to the collection roller 43 over an entire region thereof in its longitudinal direction (a direction perpendicular to a plane of FIG. 7). The sheet member 50 is a sheet-shaped member made of, for example, polyurethane and is in contact with the collection roller 43 under a prescribed contact pressure. The contact pressure to be applied from the sheet member 50 is set to such a value that residual toner adhering to the collection roller 43 is not scraped off and residual toner or the like scraped off by the blade 45 is prevented from being conveyed again toward the collection roller 43.

A seal member 51 made of an elastic material such as urethane foam or urethane sponge is disposed between each of both ends of the collection roller 43 and the housing 40. As shown in FIG. 7, the seal member 51 is disposed to extend in a circular arc shape in side view so as to contact an outer circumferential surface of the collection roller 43 in an area on an upstream side of the blade 45 and a downstream side of the sheet member 50 with respect to the rotation direction of the collection roller 43 (the clockwise direction in FIG. 7) and to further extend downward along the sheet member 50. The seal member 51 is compressed between the collection roller 43 and the housing 40, thus preventing entry of toner into a gap between the collection roller 43 and the housing 40 and leakage of toner to the outside of the housing 40.

Figure 8:
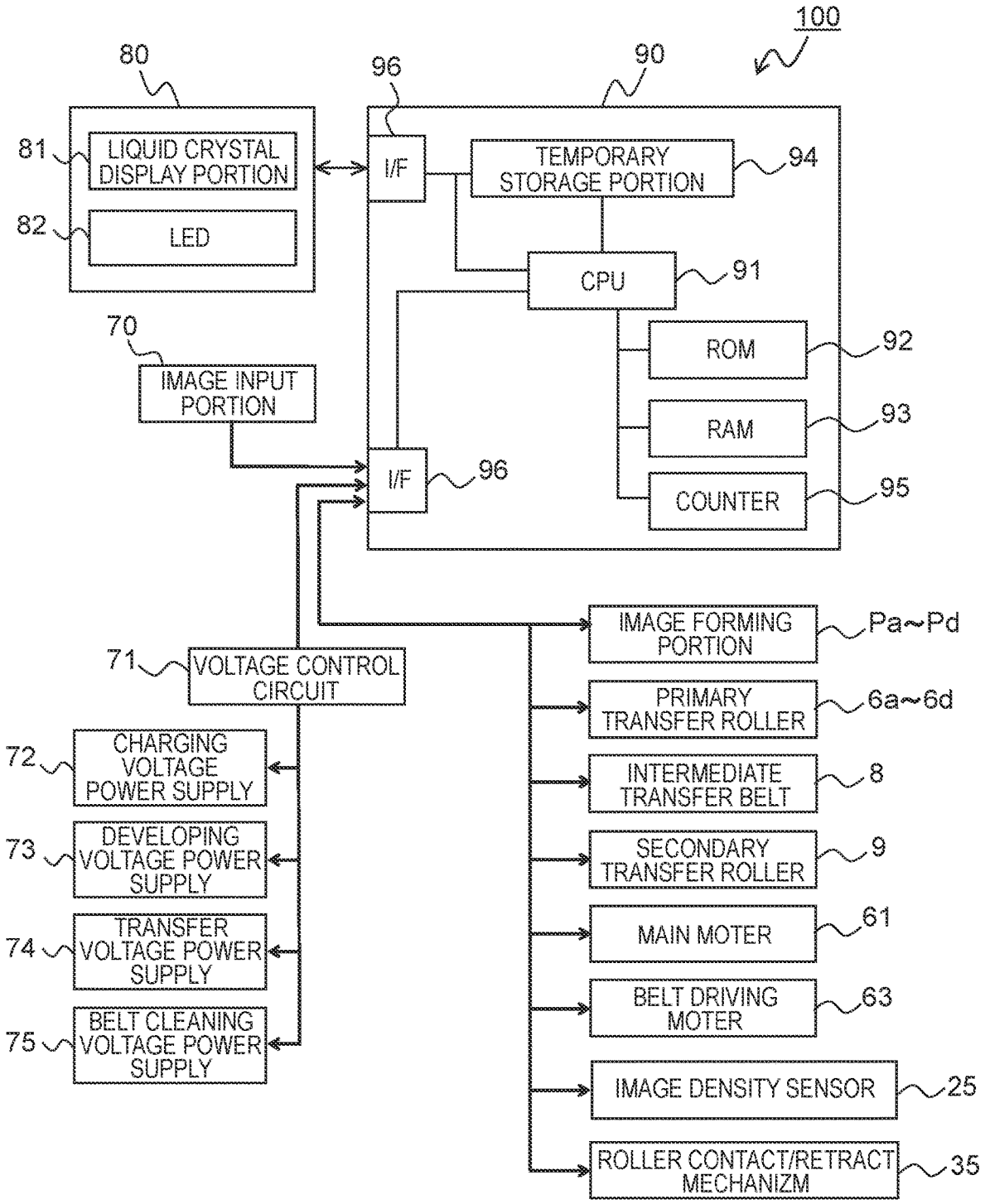
FIG. 8 is a block diagram showing one example of a control route of the image forming apparatus.

FIG. 8 is a block diagram showing one example of a control route used in the image forming apparatus 100. In using the image forming apparatus 100, the various portions thereof are controlled in different ways, so that the control route of the image forming apparatus 100 as a whole is complicated. Here, a description of the control route, therefore, focuses on parts thereof necessary for implementing the present disclosure.

The control section 90 includes at least a CPU (central processing unit) 91 as a central processor, a ROM (read-only memory) 92 that is a read-only storage portion, a RAM (random-access memory) 93 that is a readable/writable storage portion, a temporary storage portion 94 that temporarily stores image data or the like, a counter 95, and a plurality of (here, two) I/Fs (interfaces) 96 that transmit a control signal to the various devices in the image forming apparatus 100 and receive an input signal from an operation section 80. Furthermore, the control section 90 can be disposed at any location inside the main body of the image forming apparatus 100.

The ROM 92 contains data and so on that are not changed during use of the image forming apparatus 100, such as a control program for the image forming apparatus 100 and numerical values required for control. The RAM 93 stores data necessitated in the course of controlling the image forming apparatus 100, data temporarily required for control of the image forming apparatus 100, and so on. Furthermore, the RAM 93 (or the ROM 92) also stores a density correction table used in calibration, a pattern of applying a secondary transfer voltage in after-mentioned belt cleaning control, and so on. The counter 95 counts the number of sheets printed in a cumulative manner.

Furthermore, the control section 90 transmits a control signal to the various portions and devices in the image forming apparatus 100 via, the I/Fs 96. Furthermore, from the various portions and devices, a signal indicating a status thereof or an input signal is transmitted to the CPU 91 via the I/Fs 96. Examples of the various portions and devices controlled by the control section 90 include the image forming portions Pa to Pd, the exposure device 5, the primary transfer rollers 6*a* to 6*d*, the secondary transfer roller 9, the roller contact/retract mechanism 35, the main motor 61, the belt drive motor 63, a voltage control circuit 71, and the operation section 80.

An image input portion 70 is a receiving portion that receives image data transmitted from a host apparatus such as a personal computer to the image forming apparatus 100. An image signal inputted from the image input portion 70 is converted into a digital signal, which then is fed out to the temporary storage portion 94.

The voltage control circuit 71 is connected to a charging voltage power supply 72, a developing voltage power supply 73, a transfer voltage power supply 74, and the belt cleaning voltage power supply 75 and operates each of these power supplies in accordance with an output signal from the control section 90. In accordance with a control signal from the voltage control circuit 71, the charging voltage power supply 72 applies a predetermined voltage to the charging roller 20 in each of the charging devices 2*a* to 2*d*, the developing voltage power supply 73 applies a prescribed voltage to the developing roller 21 in each of the developing devices 3*a* to 3*d*, the transfer voltage power supply 74 applies a prescribed voltage to each of the primary transfer rollers 6*a* to 6*d* and the secondary transfer roller 9, and the belt cleaning voltage power supply 75 applies a prescribed voltage to the collection roller 43 of the belt cleaning unit 19.

In the operation section 80, there are provided a liquid crystal display portion 81 and LEDs 82 that indicate various types of statuses. A user operates a stop/clear button of the operation section 80 to stop image formation and operates a reset button thereof to bring various types of settings for the image forming apparatus 100 to a default state. The liquid crystal display portion 81 indicates a status of the image forming apparatus 100 and displays an image forming situation and the number of copies printed. The various types of settings for the image forming apparatus 100 are made via a printer driver of a personal computer.

As described earlier, in the belt cleaning unit 19 using the fur brush 41 as a cleaning member, in a case of cleaning patch images formed at the time of executing calibration, toner supplied in a large amount can hardly be collected at once by the fur brush 41 and may partly remain on the intermediate transfer belt 8, which has been disadvantageous. Such residual toner can be collected by increasing the number of revolutions (a duration of revolution) of the intermediate transfer belt 8, in which case, however, a calibration execution time is increased.

In a case, however, where, at the time of executing calibration, a transfer voltage having a polarity opposite to that of toner is applied to the secondary transfer roller 9 and used to transfer patch images on the intermediate transfer belt 8 to the secondary transfer roller 9, an amount of toner supplied to the belt cleaning unit 19 is reduced, and thus the toner can be collected at once by the fur brush 41. This, however, has still been disadvantageous in that, at the end of calibration, a reverse transfer voltage having a polarity identical to that of toner is applied to the secondary transfer roller 9 and used to transfer the toner on the secondary transfer roller 9 back to the intermediate transfer belt 8, a part of the toner might remain on the secondary transfer roller 9, causing staining on a rear surface of the sheet S in an immediately succeeding printing operation.

To solve these problems, in the image forming apparatus 100 according to this embodiment, an execution time of a cleaning assist mode in which patch images on the intermediate transfer belt 8 are transferred to the secondary transfer roller 9 is limited to a bare minimum. This eliminates troubles such as toner failing to be collected at once by the fur brush 41 and partly remaining on the intermediate transfer belt 8 (cleaning failure) and a calibration time being prolonged and maximally suppresses residual toner remaining on the secondary transfer roller 9.

Specifically, patch images on the intermediate transfer belt 8 are required to be cleaned at once in either a case where calibration is being continued even after the intermediate transfer belt 8 has revolved once (hereinafter, referred to as "after one belt revolution") and thus patch images are to be newly formed or a case where a printing operation is to be performed after one belt revolution. In contrast to this, in a case where calibration has ended after one belt revolution and thus no printing operation is to be performed, the patch images are not required to be cleaned at once. In this case, residual toner remaining on the intermediate transfer belt 8 could be cleaned by increasing the number of revolutions (a duration of revolution) of the intermediate transfer belt 8.

That is, in a case of forming a toner image after one belt revolution, the cleaning assist mode is executed so that an amount of toner supplied to the belt cleaning unit 19 is reduced, and thus the toner can be collected at once by the fur brush 41. In a case, however, of not forming a toner image after one belt revolution, the cleaning assist mode is not executed, and toner transfer to the secondary transfer roller 9 is prohibited. Thus, it is possible to suppress residual toner remaining on the secondary transfer roller 9 and to reduce an unnecessary drive time of the intermediate transfer belt 8 so as to maximally reduce a printing wait time (a down time).

Figure 9:
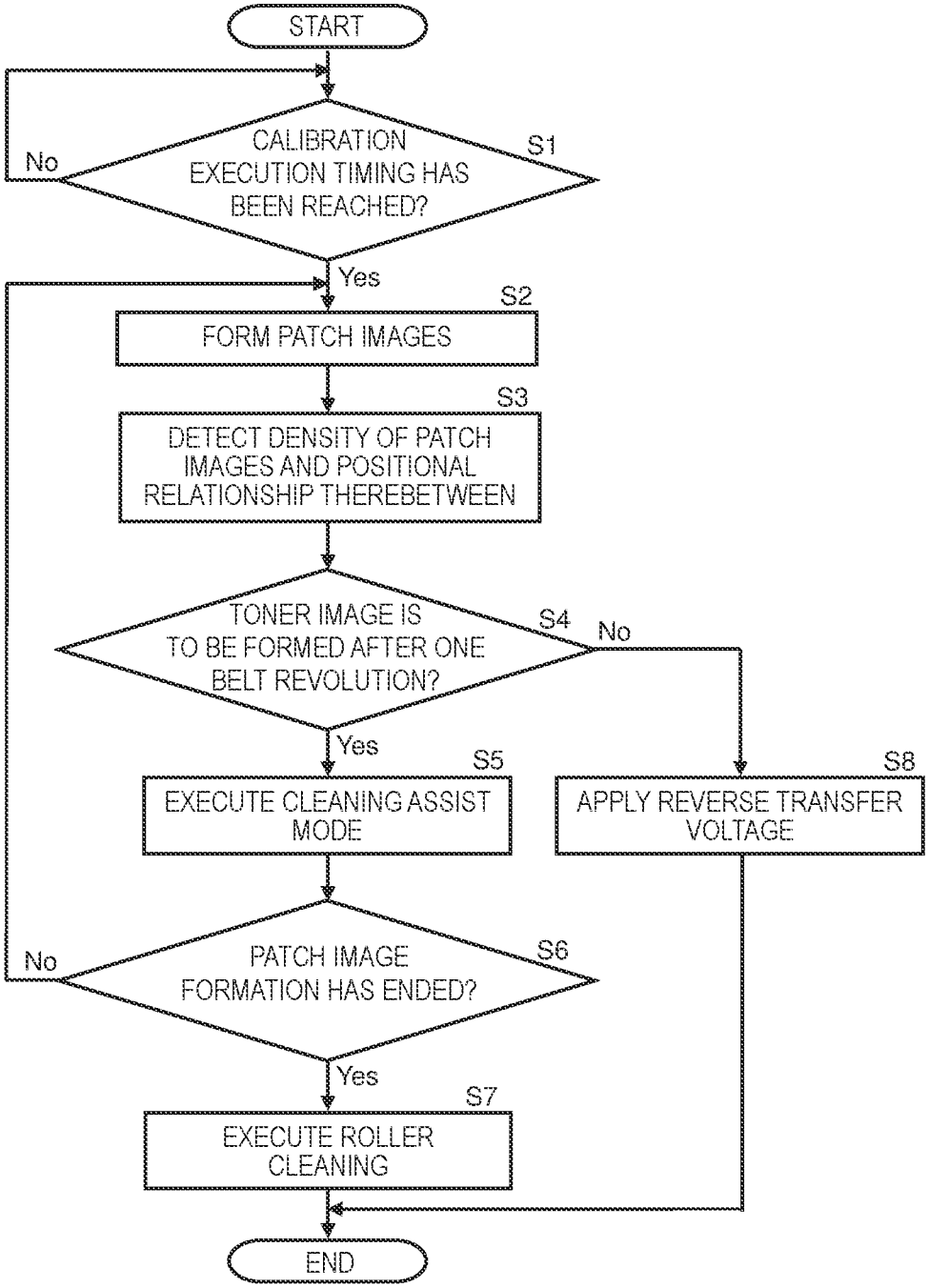
FIG. 9 is a flow chart showing an example of belt cleaning control performed during calibration executed in the image forming apparatus.

FIG. 9 is a flow chart showing an example of belt cleaning control performed during calibration executed in the image forming apparatus 100 of the present disclosure. With reference to FIG. 1 to FIG. 8 and after-mentioned FIG. 10 as required, a description is given of a procedure for executing belt cleaning by following steps shown in FIG. 9.

First, the control section 90 determines whether or not calibration execution timing has been reached (step S1). The calibration execution timing is reached when, for example, the image forming apparatus 100 is turned on, a recovery is made from a power saving (sleep) mode, a cumulative number of sheets that have been printed since last calibration has reached a prescribed number. In a case where such a calibration execution condition is not met at step S1 (No at step S1), calibration is not executed, and a printing instruction standby state is continued.

In a case where the calibration execution timing has been reached (Yes at step S1), calibration is started. Specifically, for the respective colors of magenta, cyan, yellow, and black, a plurality of patch images in, c, y, and k for density correction and a plurality of patch images M, C, Y, and K for color deviation correction are formed (step S2). Then, a density of the patch images m, c, y, and k as transferred onto the intermediate transfer belt 8 and a positional relationship between the patch images M, C, Y, and K as transferred onto the intermediate transfer belt 8 are detected by the image density sensor 25 (step S3), and a result of the detection is used to execute the calibration.

Furthermore, the control section 90 determines whether or not to form a toner image after one belt revolution (step S4). A toner image is formed after one belt revolution in either a case where calibration is being continued even after one belt revolution and thus patch images are to be newly formed or a case where a printing operation is scheduled to be performed immediately after the end of calibration.

A toner image is formed after one belt revolution (Yes at step S4) in either the case where calibration is being continued and thus patch images are to be continuously formed or the case where calibration has ended and a printing operation is to be executed immediately thereafter. In such a case, residual toner on the intermediate transfer belt 8 is required to be cleaned at once by the belt cleaning unit 19.

To this end, the control section 90 executes the cleaning assist mode in which a part of patch images on the intermediate transfer belt 8 is transferred to the secondary transfer roller 9 (step S5). Specifically, the control section 90 transmits a control signal to the voltage control circuit 71 so that a transfer voltage having a polarity (a negative polarity) opposite to that of toner and a reverse transfer voltage having a polarity (a positive polarity) identical to that of the toner are applied alternately from the transfer voltage power supply 74 to the secondary transfer roller 9, and thus a part of the patch images is transferred to the secondary transfer roller 9. More particularly, as shown in after-mentioned FIG. 10, the transfer voltage and the reverse transfer voltage are applied in such a manner as to be switched depending on a formation position of the patch images on the intermediate transfer belt 8.

Next, the control section 90 determines whether or not patch image formation has ended (step S6). In a case where the patch image formation is being continued (No at step S6), a return is made to step S2 where the patch image formation and detection of an image density and an image position are continued. In a case where the patch image formation has ended (Yes al step S6), a printing operation is to be executed immediately thereafter, and thus in preparation for the printing operation, roller cleaning is executed in which a reverse transfer voltage is applied to the secondary transfer roller 9 so that toner transferred to the secondary transfer roller 9 is transferred back onto the intermediate transfer belt 8 (step S7).

On the other hand, a toner image is not formed after one belt revolution at step S4 (No at step S4) in a case where calibration has ended and a printing operation is not to be performed immediately thereafter. In this case, residual toner on the intermediate transfer belt 8 is not required to be cleaned at once by the belt cleaning unit 19. The control section 90, therefore, transmits a control signal to the voltage control circuit 71 so that a reverse transfer voltage is applied from the transfer voltage power supply 74 to the secondary transfer roller 9 (step S8). Thus, patch image transfer to the secondary transfer roller 9 is prohibited.

Figure 10:
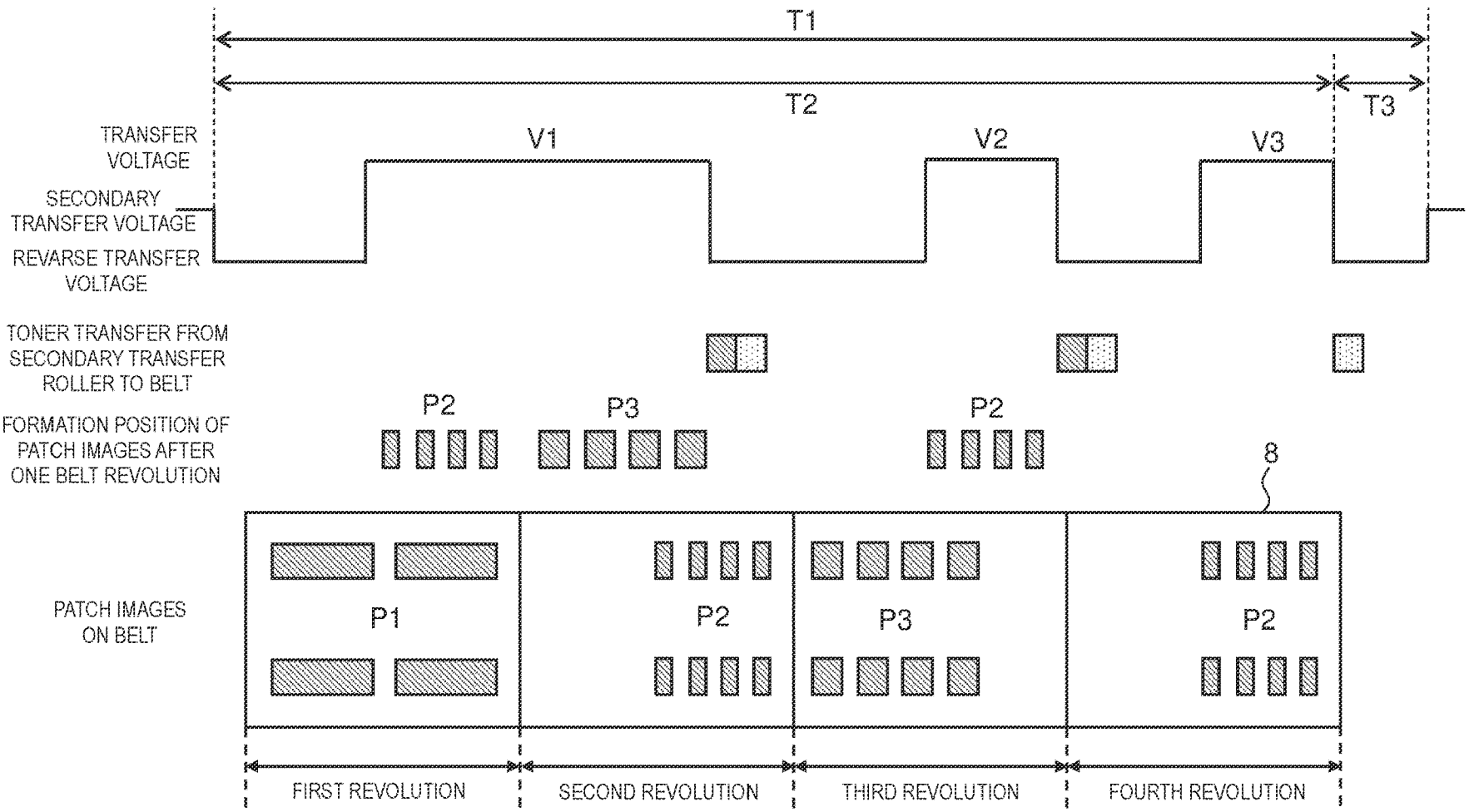
FIG. 10 is a timing chart showing a procedure for applying a transfer voltage and a reverse transfer voltage to a secondary transfer roller in a cleaning assist mode.

FIG. 10 is a timing chart showing a procedure for applying a transfer voltage and a reverse transfer voltage to the secondary transfer roller 9 in the cleaning assist mode. In FIG. 10, a calibration execution time is denoted as T1, a patch image forming time as T2, and a cleaning time of the secondary transfer roller 9 (a roller cleaning time) as T3. Furthermore, FIG. 10 also illustrates patch images formed on the intermediate transfer belt 8, a formation position of patch images after one belt revolution, and timing for transferring toner from the secondary transfer roller 9 onto the inter mediate transfer belt 8.

Furthermore, in executing calibration, the intermediate transfer belt 8 is caused to revolve four times, and patch images constituting a pattern P1 are firmed during the first belt revolution. Similarly, patch images constituting a pattern P2 are formed during the second belt revolution, and patch images constituting a pattern P3 are formed during the third belt revolution. Patch images constituting the pattern P2 are formed again during the fourth belt revolution.

Here, when immediately previously formed patch images are remaining at a formation position of patch images after one belt revolution, accuracy in detecting the patch images formed after one belt revolution is decreased. To avoid this, in this control example, at timing at which the formation position of patch images after one belt revolution passes by the secondary transfer roller 9, a transfer voltage is applied to the secondary transfer roller 9. Furthermore, at any other timing, a reverse transfer voltage is applied to the secondary transfer roller 9 so that patch image transfer to the secondary transfer roller 9 is prohibited. The following describes a specific procedure for applying the transfer voltage and the reverse transfer voltage.

As shown in FIG. 10, at a point in time when formation of the patch images constituting the pattern P1 is started during the first belt revolution, the reverse transfer voltage is being applied to the secondary transfer roller 9. Accordingly, a part (a first half part) of the patch images constituting the pattern P1 arrives at the belt cleaning unit 19 while remaining on the intermediate transfer belt 8. During the second belt revolution, no patch images are formed at a first half part of the intermediate transfer belt 8, and thus even if the first half part of the patch images constituting the pattern P1 remains on the intermediate transfer belt 8 without being removed by the belt cleaning unit 19, no influence will be exerted on calibration.

During the second belt revolution, the patch images constituting the pattern P2 are formed at a latter half part of the intermediate transfer belt 8. Based on this, application of a first transfer voltage V1 is started at timing at which the latter half part of the intermediate transfer belt 8 during the first belt revolution arrives at the secondary transfer roller 9 so that a part (a latter half part) of the patch images constituting the pattern P1 is transferred onto the secondary transfer roller 9.

Similarly, during the third belt revolution, the patch images constituting the pattern P3 are formed at the first half part of the intermediate transfer belt 8. Based on this, the application of the first transfer voltage V1 is continued even at timing at which the first half part of the intermediate transfer belt 8 during the second belt revolution arrives at the secondary transfer roller 9 so that residual toner remaining at the first half part of the intermediate transfer belt 8 is transferred onto the secondary transfer roller 9.

Further, at a point in time when a formation position of the patch images constituting the pattern P3 has passed, switching from the first transfer voltage V1 to the reverse transfer voltage is performed. At this time, a part (a latter half part) of the patch images constituting the pattern P2 arrives at the belt cleaning unit 19 while remaining on the intermediate transfer belt 8. Furthermore, a part of patch images transferred to the secondary transfer roller 9 is transferred back onto the intermediate transfer belt 8. During the third belt revolution, no patch images are formed at the latter half part of the intermediate transfer belt 8, and thus even if the latter half part of the patch images constituting the pattern P2 or a part of toner transferred back from the secondary transfer roller 9 remains on the intermediate transfer belt 8, no influence will be exerted on calibration.

Similarly, during the fourth belt revolution, the patch images constituting the pattern P2 are formed at the latter half part of the intermediate transfer belt 8. Based on this, application of a second transfer voltage V2 is started at timing at which the latter half part of the intermediate transfer belt 8 during the third belt revolution arrives at the secondary transfer roller 9 so that a part (a latter half part) of the patch images constituting the pattern P3 is transferred onto the secondary transfer roller 9. A part (a first half part) of the patch images constituting the pattern P3, on the other hand, arrives at the belt cleaning unit 19 while remaining on the intermediate transfer belt 8.

Further, at a point in time when a formation position of the patch images constituting the pattern P2 has passed, switching from the second transfer voltage V2 to the revere transfer voltage is performed. Thus, the part of the patch images transferred to the secondary transfer roller 9 is transferred back onto the intermediate transfer belt 8. During the fourth revolution, no patch images are formed at the first half part of the intermediate transfer belt 8, and thus even if the first half part of the patch images constituting the pattern P3 or a part of toner transferred back from the secondary transfer roller 9 remains on the intermediate transfer belt 8, no influence is exerted on calibration.

Finally, application of a third transfer voltage V3 is started at timing at which the patch images constituting the pattern P2 formed during the fourth belt revolution arrives, and at a point in time when the patch images constituting the pattern P2 has passed, switching from the third transfer voltage V3 to the reverse transfer voltage is performed. Then, a printable state is brought about at a point in time when the patch images transferred to the secondary transfer roller 9 are cleaned.

Timing at which a formation position of patch images after one belt revolution arrives at the secondary transfer roller 9 can be calculated from timing at which patch images are primarily transferred to the intermediate transfer belt 8 at the image forming portions Pa to Pd, a distance from the image forming portions Pa to Pd to the secondary transfer roller 9, and a conveyance speed of the intermediate transfer belt 8.

It is also possible to switch an application pattern of a transfer voltage depending on whether patch images formed after one belt revolution are used for color deviation correction or density correction. Specifically, the patch images m, c, y, and k for density correction (see FIG. 4) are likely to be influenced by a base member (a belt surface) when density detection is performed by the image density sensor 25. It is, therefore, preferable that the patch images m, c, y, and k be always formed at a constant position on the intermediate transfer belt 8.

For this reason, in a case where patch images formed after one belt revolution are the patch images m, c, y, and k for density correction, as shown in FIG. 10, at timing at which a formation position of patch images after one belt revolution passes by the secondary transfer roller 9, a transfer voltage is applied to the secondary transfer roller 9 so that the patch images are transferred to the transfer roller 9. Thus, patch images at the forming position of patch images after one belt revolution can be completely removed by the belt cleaning unit 19, so that accuracy in detecting patch images for density correction is improved.

As for the patch images M, C, Y, and K for color deviation correction (see FIG. 3), it is sufficient to detect their positions, and thus there is no need to take into consideration an influence of the base member (the belt surface). The patch images M, C, Y, and K, therefore, may be formed at a varying position on the intermediate transfer belt 8. Based on this, in a case where patch images formed after one belt revolution are the patch images M, C, Y, and K for color deviation correction, a reverse transfer voltage is applied to the secondary transfer roller 9 so that the patch images are not transferred to the secondary transfer roller 9. Further, after one belt revolution, patch images are formed at a position at which no patch images had been formed prior to the one belt revolution. Thus, an amount of toner transferred to the secondary transfer roller 9 is reduced, so that toner staining on the secondary transfer roller 9 can be suppressed to a bare minimum.

In a case where a printing operation is scheduled to be performed after execution of calibration, in order to prevent staining on the rear surface of the sheet S, it is necessary to secure, as the roller cleaning time T3, a sufficient amount of time to be able to completely transfer toner transferred onto the secondary transfer roller 9 back onto the intermediate transfer belt 8.

Furthermore, in a case where no printing operation is scheduled to be performed immediately after execution of calibration, there is no need for application of the third transfer voltage V3 shown in FIG. 3. Further, a printable state is brought about at a point in time when the intermediate transfer belt 8 has revolved until patch images constituting the pattern P2 formed on the intermediate transfer belt 8 at the end of calibration (during the fourth belt revolution) are completely cleaned by the belt cleaning unit 19.

According to the above-described control example, in a case where a toner image is to be formed on the intermediate transfer belt 8 after one belt revolution, the cleaning assist mode is executed in which a transfer voltage and a reverse transfer voltage are alternately applied to the secondary transfer roller 9, and thus an amount of toner on the intermediate transfer belt 8 is reduced. As a result, the toner on the intermediate transfer belt 8 can be cleaned at once by the belt cleaning unit 19. Furthermore, the application of the reverse transfer voltage causes toner transferred to the secondary transfer roller 9 to be transferred back onto the intermediate transfer belt 8, and thus it is also possible to reduce a cleaning time of the secondary transfer roller 9.

Furthermore, a transfer voltage is applied to the secondary transfer roller 9 depending on a formation position of patch images after one belt revolution, and thus immediately previously formed patch images can be prevented from remaining at the formation position of patch images after one belt revolution. As a result, accuracy in detecting patch images formed after one belt revolution is improved.

Furthermore, in a case where no toner image is to be formed on the intermediate transfer belt 8 after one belt revolution, a reverse transfer voltage is applied to the secondary transfer roller 9 so that toner transfer to the secondary transfer roller 9 is prohibited. As a result, it is possible to reduce an amount of toner adhering to the secondary transfer roller 9 and thus to effectively suppress staining on the rear surface of the sheet S. Furthermore, it is also possible to reduce a cleaning time of the secondary transfer roller 9 and thus to maximally reduce a calibration execution time.

In the above-described control example, a transfer voltage and a reverse transfer voltage are alternately applied to the secondary transfer roller 9 in the cleaning assist mode so that an amount of toner transferred to the secondary transfer roller 9 is reduced. A configuration, however, may also be adopted in which a transfer voltage lower than a transfer voltage (a reference transfer voltage) applied to secondarily transfer a toner image on the intermediate transfer belt 8 to the sheet S is used as the transfer voltage to be applied to the secondary transfer roller 9 so that an amount of toner transferred to the secondary transfer roller 9 in the cleaning assist mode is further reduced.

For example, a transfer voltage of such a level that 50% of toner forming patch images is transferred is applied to the secondary transfer roller 9 in the cleaning assist mode, so that the other 50% of the toner remaining after passing by the secondary transfer roller 9 is removed by the belt cleaning unit 19. That is, a transfer voltage of such a level that an amount of residual toner remaining on the intermediate transfer belt 8 after passing by the secondary transfer roller 9 is not more than a maximum amount of toner removable at once by the belt cleaning unit 19 is applied, and thus it is possible to suppress cleaning failure and to reduce an amount of toner adhering to the secondary transfer roller 9 to a minimum.

Other than the above, the present disclosure is not limited to the foregoing embodiment and can be variously modified without departing from the spirit of the present disclosure. For example, while the foregoing embodiment uses, as an example, the belt cleaning unit 19 including the fur brush 41, the present disclosure is applicable also to a configuration using a cleaning roller instead of the fur brush 41.

Furthermore, the present disclosure is not limited to a tandem-type color printer shown in FIG. 1 and is applicable to various types of image forming apparatuses each using an intermediate transfer belt and a belt cleaning device, such as a color copy machine and a color multi-functional peripheral.

The present disclosure is usable in an intermediate transfer-type image forming apparatus including an intermediate transfer belt. Through the use of the present disclosure, it is possible to provide an image forming apparatus capable of efficiently removing a toner image formed on a surface of an intermediate transfer belt at the time of executing calibration so as to maximally reduce a calibration execution time and also suppressing staining on a rear surface of a recording medium attributable to residual toner remaining on a secondary transfer member.

What is claimed is:

1. An image forming apparatus, comprising:

a plurality of image forming portions that form images of different colors from each other;

an intermediate transfer belt that is endless and moves along the image forming portions;

a plurality of primary transfer members that each are disposed to be opposed, via the intermediate transfer belt, to an image carrier disposed in a corresponding one of the image forming portions and primarily transfer a toner image formed on the image carrier onto the intermediate transfer belt;

a belt cleaning device that includes a cleaning member disposed at a position opposed to the intermediate transfer belt and removes a residual part of toner remaining on a surface of the intermediate transfer belt;

a secondary transfer member that secondarily transfers, onto a recording medium, the toner image primarily transferred onto the intermediate transfer belt;

a voltage application device that applies, to the secondary transfer member, a transfer voltage having a polarity opposite to a polarity of the toner or a reverse transfer voltage having a polarity identical to the polarity of the toner;

an image density sensor that detects a density and positional information of the toner image primarily transferred onto the intermediate transfer belt; and a control section that controls the image forming portions and the voltage application device, the image forming apparatus being configured to execute calibration in which a density and positional information of patch images formed on the intermediate transfer belt are detected by the image density sensor, and based on a result of the detection, an image forming condition is adjusted so as to correct a density and a color deviation of the toner image, wherein the control section is capable of executing a cleaning assist mode in which, at a time of executing the calibration, the transfer voltage and the reverse transfer voltage are alternately and repeatedly applied to the secondary transfer member so that a part of the patch images formed on the intermediate transfer belt is transferred to the secondary transfer member, and in a case of continuously forming the patch image on the intermediate transfer belt after the intermediate transfer belt has revolved once, the control section executes the cleaning assist mode depending on a formation position of the patch images after one belt revolution of the intermediate transfer belt, and in a case of not forming the toner image on the intermediate transfer belt after the intermediate transfer belt has revolved once, the control section continuously applies the reverse transfer voltage to the secondary transfer member so that patch image transfer to the secondary transfer member is prohibited.

2. The image forming apparatus according to claim 1, wherein the control section executes the cleaning assist mode by applying the transfer voltage to the secondary transfer member at timing at which a formation position of the patch images formed on the intermediate transfer belt after the intermediate transfer belt has revolved once passes by the secondary transfer member and applying the reverse transfer voltage to the secondary transfer member at any other timing.

3. The image forming apparatus according to claim 2, wherein the control section executes the cleaning assist mode when the patch images formed on the intermediate transfer belt after the intermediate transfer belt has revolved once are patch images for density correction.

4. The image forming apparatus according to claim 1, wherein the control section executes the cleaning assist mode by applying to the secondary transfer member, as the transfer voltage, a voltage lower than a reference transfer voltage applied so that the toner image on the intermediate transfer belt is secondarily transferred onto the recording medium.

5. The image forming apparatus according to claim 4, wherein the control section executes the cleaning assist mode by applying to the secondary transfer member, as the transfer voltage, a voltage of such a level that an amount of residual toner remaining on the intermediate transfer belt after passing by the secondary transfer member is not more than a maximum amount of toner removable at once by the belt cleaning device.

6. The image forming apparatus according to claim 1, wherein when the toner image formed on the intermediate transfer belt after the intermediate transfer belt has revolved once is a printed image to be transferred onto the recording medium, the control section executes secondary transfer cleaning in which the reverse transfer voltage is applied to the secondary transfer member so that the patch images transferred to the secondary transfer member in the cleaning assist mode are transferred back onto the intermediate transfer belt.

7. The image forming apparatus according to claim 1 wherein the cleaning member is a fur brush.

* * * * *